United States Patent [19]

Amado, Jr.

[11] 4,196,608

[45] Apr. 8, 1980

[54] METHOD OF AND APPARATUS FOR FORMING PROJECTIONS ON TUBULAR MEMBERS OR THE LIKE

[76] Inventor: Juan J. Amado, Jr., Aptdo. 4241, Panama 5, Panama

[21] Appl. No.: 925,169

[22] Filed: Jul. 17, 1978

[51] Int. Cl.[2] ..... B21D 15/04

[52] U.S. Cl. ..... 72/75; 72/77

[58] Field of Search ..... 72/75, 77, 78

[56] References Cited

U.S. PATENT DOCUMENTS

| | | | |
|---|---|---|---|
| 568,574 | 9/1896 | Hoyer | 72/75 |
| 629,245 | 7/1899 | Frank | 72/75 |
| 1,727,918 | 9/1929 | Ziegler | 72/75 |
| 2,377,406 | 6/1945 | Dedrick | 72/75 |

FOREIGN PATENT DOCUMENTS

| | | | |
|---|---|---|---|
| 236473 | 10/1959 | Australia | 72/75 |

*Primary Examiner*—Lowell A. Larson
*Attorney, Agent, or Firm*—Richard P. Matthews

[57] ABSTRACT

A method of and apparatus for forming projections on tubular members or the like in which the tube forming apparatus rotates with respect to the tubular article being formed. A mandrel is provided with camming wedge members which actuate spherical forming members when the mandrel is reciprocated. Each spherical forming member projects through an aperture in a housing member which closely surrounds the mandrel. In this manner the spherical forming members engage a tubular article on the mandrel and force the contacted portion of the tubular article into a die member. The mandrel, housing member and spherical forming members are then rotated with respect to the tubular article to be formed whereby a predetermined projection is formed on the tubular article.

12 Claims, 11 Drawing Figures

METHOD OF AND APPARATUS FOR FORMING PROJECTIONS ON TUBULAR MEMBERS OR THE LIKE

BACKGROUND OF THE INVENTION

This invention relates to a method of and apparatus for forming projections on tubular members or the like and, more particularly, to the formation of such bulged articles by an apparatus which rotates with respect to the article being formed.

Heretofore it has been known to form projections on tubes by various means including the use of cooperatively shaped rollers one of which is inserted within the tube to be formed while the other engages the exterior of the tube. Such a system is objectionable not only because of the slowness of this arrangement but also because of the difficulty in controlling the rollers as distance from the origin of the driving force to the point of application to the tubular member increases.

Another approach to the problem has been to substitute a shaped or grooved mandrel for one of the cooperatively shaped rollers. One advantage in this approach is that a plurality of exterior rollers may be employed in unison to increase the speed of formation. A principal disadvantage of this approach, however, is that the mandrel must be quite massive to provide suitable rigidity. The system lacks versatility in that substantially only a single product can be produced with a given mandrel. It is also quite expensive to employ this system.

SUMMARY OF THE INVENTION

In accordance with the present invention, the foregoing disadvantages and shortcomings of known prior art systems and arrangements have been effectively overcome. In particular, the present invention utilizes a mandrel which is provided with a plurality of camming wedge members on its surface. The mandrel is adjustably positioned within a housing mandrel and is dimensionally arranged such that reciprocation of the mandrel moves the spherical forming members into and out of associated apertures in the housing member.

A die member is also positioned in registry with the apertures in the housing member. Thus, when a tubular member to be formed is positioned between the housing member and the die member, the rotation in unison of the mandrel, the housing member and the die member causes the spherical forming members when they extend through the apertures in the housing member to form a desired projection on the tubular member.

In one form of the invention, the spherical forming members travel in a helical or spiral path thereby causing the tubular member to be ejected axially as it is being formed. In another form of the invention, the spherical forming members travel in a circular path, producing a toroid, and the die member is split or formed from plural parts to permit the formed tubular member to be removed.

The inherent advantages and improvements of the present invention will become more readily apparent by reference to the following description of a preferred embodiment of the invention and by reference to the accompanying drawings.

DETAILED DESCRIPTION OF A PREFERRED EMBODIMENT

Figure 1:
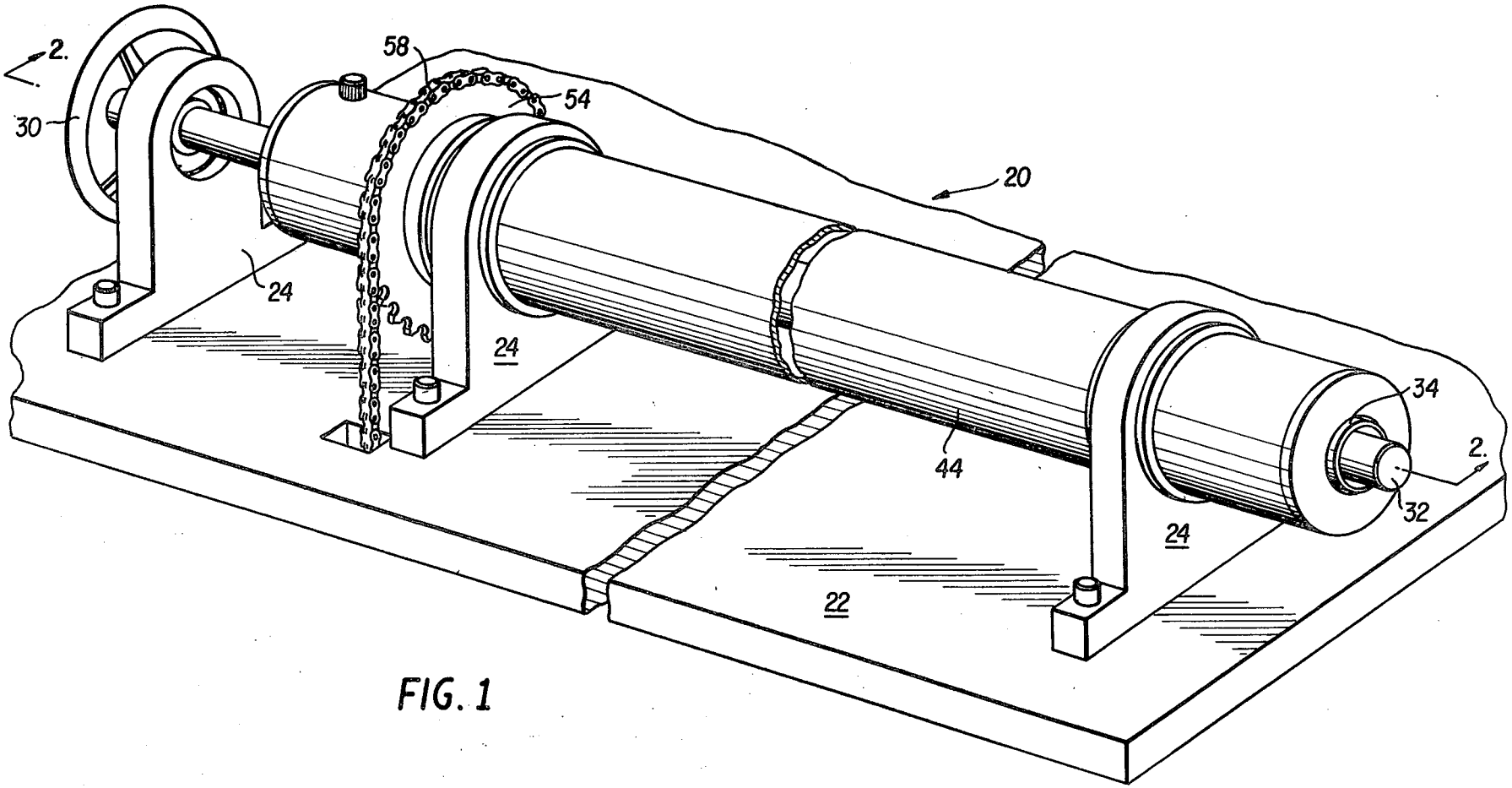
FIG. 1 is a fragmentary perspective view showing the tube forming apparatus of the present invention.
Figure 2:
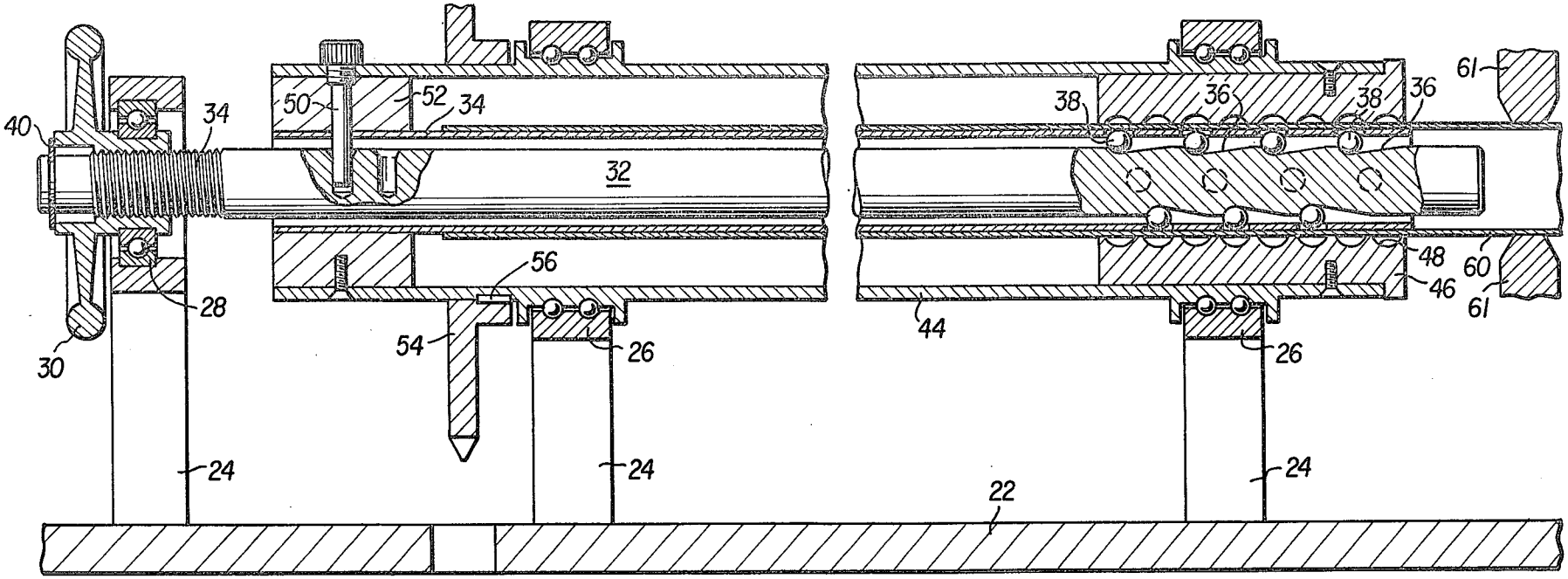
FIG. 2 is a front elevational view taken in vertical cross section along line 2—2 of FIG. 1.
Figure 3:
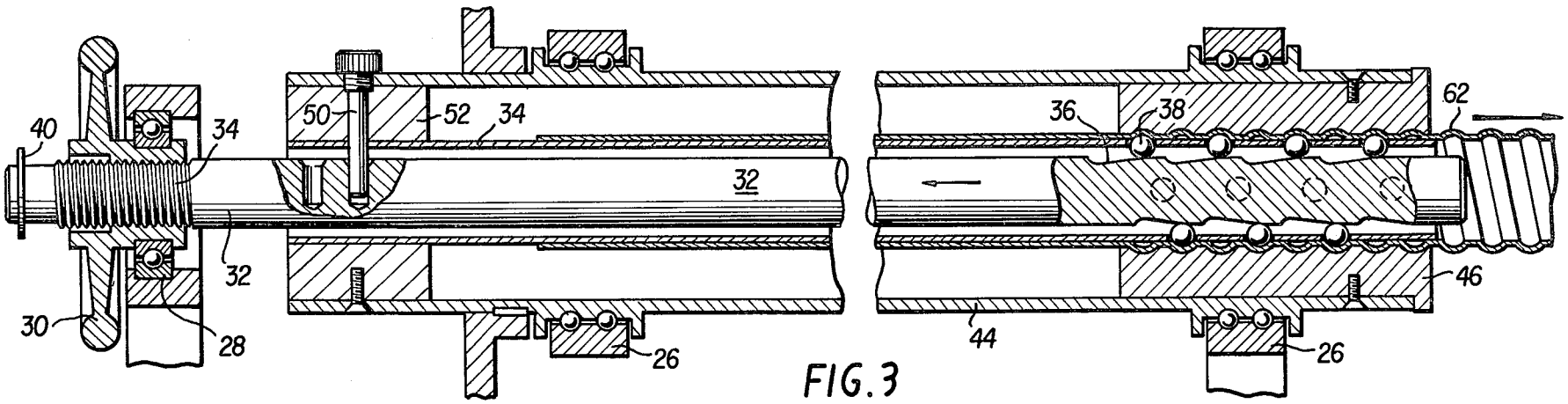
FIG. 3 is a front elevational view taken in vertical cross section similar to FIG. 2 but illustrating a different position for the tube forming elements.

Referring now to FIGS. 1–3 of the drawings, there is illustrated an apparatus for forming projections on tubular products with the apparatus indicated generally by numeral 20. This apparatus 20 is suitably attached to a machine bed 22 having standards or supports 24 bolted thereto for supporting main bearings 26 and an auxiliary bearing 28. A handwheel 30 is maintained captive on a mandrel 32, a major portion of which is cylindrical in cross section. A portion of mandrel 32 is threaded at 34 to receive the internal threads of the captive handwheel 30 for purposes of reciprocating and thereby positioning mandrel 32 in order to form projections on a tubular element in a manner to be described hereafter.

Figure 7:
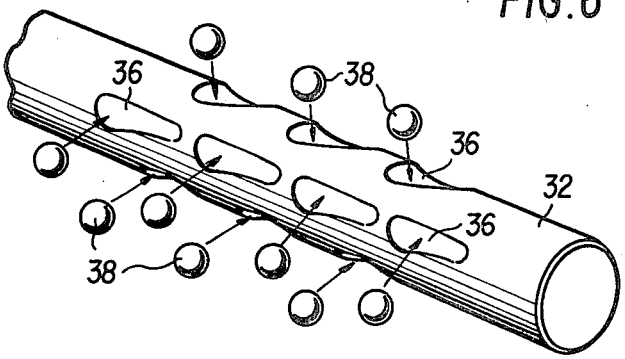
FIG. 7 is a fragmentary, exploded perspective view of the tube forming mandrel itself and the tube forming balls.

The mandrel 32 is positioned within a housing member 34 and the mandrel has a plurality of wedge-shaped camming members 36 on its outer surface. The wedge-shaped camming members 36 serve to maintain in a captive position spherical forming members consisting of steel balls 38 by holding them within a limited space for movement as will be evident by referring to the illustration in FIG. 7. Cooperating with the wedge-shaped camming members 36 to hold the steel ball 38 captive is the housing member 34 which has a plurality of apertures 42 through which steel balls 38 partially project as is best seen in the detailed showing in FIG. 5. The handwheel 30 cooperates with the threaded portion 34 of mandrel 32 to reciprocate the mandrel 32 into a position whereby each of the steel balls 38 project through its associated aperture 42 in the housing member 34. A limit collar 40 is attached to the end of mandrel 32 to limit the movement of handwheel 32 and maintain the handwheel in position.

Figure 5:
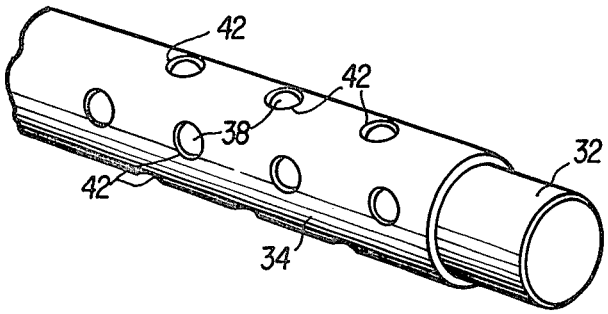
FIG. 5 is a fragmentary perspective view of a tube forming mandrel, balls and a ball retainer.
Figure 6:
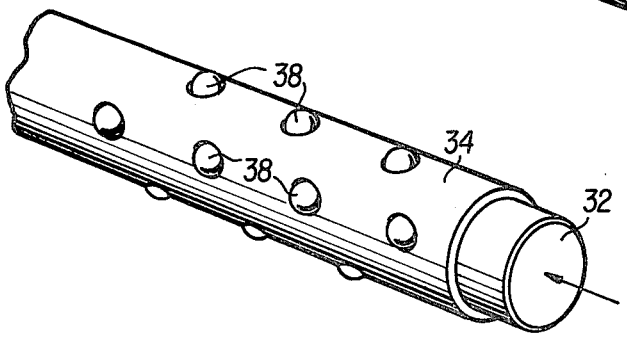
FIG. 6 is a fragmentary perspective view similar to FIG. 5 but illustrating the elements in tube forming position.

FIGS. 5 and 6 illustrate the position of the mandrel 32 and spherical forming elements 38 in two positions. In FIG. 5 the spherical forming elements 38 are not in position to form projections but in FIG. 6 the mandrel 32 has been reciprocated to a position where the spherical forming elements 38 project partially through apertures 42 so as to be in operative projection-forming position.

Figure 8:
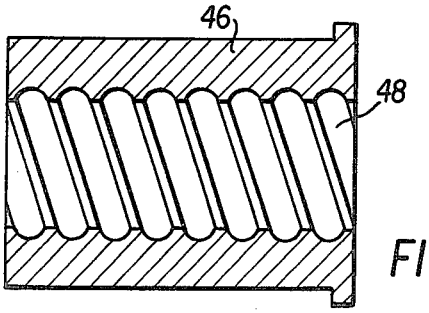
FIG. 8 is a front elevational view taken in vertical cross section showing the die member of FIG. 2.

A die holder 44 carries a die member 46 shown in detail in FIG. 8 and which has a die surface or cavity 48 therein. Cavity 48 is brought into a predetermined relationship with the apertures 42 in housing member 34 so that when the steel balls 38 are projected partially through apertures 42 the spherical forming members 38 will be in registry with the die surface 48.

The mandrel 32, housing member 34 and spherical forming members 38 all rotate in unison in order to form the projections on the tubular member. For this purpose, a pin 50 is threaded into the die holder 44 and partially into a closure block member 52 with the pin 50 extending through housing member 34 and into mandrel 32 as is clearly shown in FIGS. 2 and 3. A sprocket means 54 is attached to the die holder 44 by means of key member 56 so that a chain 58 whereby a motor, not shown, may be used to drive all of the forming elements in unison. These forming elements consist of the die holder 44 and its associated die member 46, the housing member 34, mandrel 32 and the spherical forming members 38.

Figure 4:
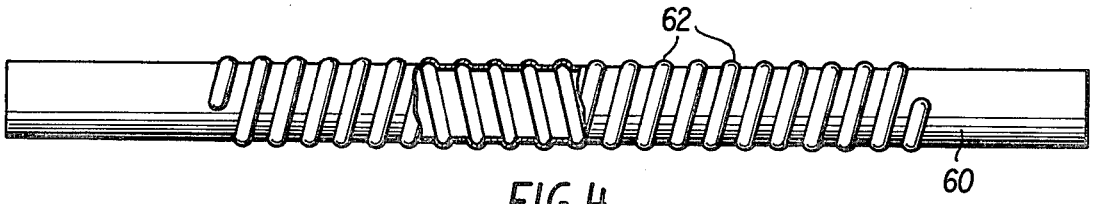
FIG. 4 is a front elevational view with a portion broken away of a spirally bulged tubular member.

A tubular member 60 to be formed is telescopically received on housing member 34 between the housing member 34 and die member 46 and an external clamp 61 is used to prevent rotation of the tubular member 60 but which permits axial ejection of the tubular member when it is formed when the die surface or cavity 48 consists of a helical groove or spiral formation. The portions of the tubular element 60 which are contacted by the sperical forming members 38 are impressed into the cavity 48 of the die member 46 and the continuous spiral projection 62 is formed thereby on its surface as is shown in FIG. 4. A die 46 having a continuous path in its cavity 48 is used to produce such a projection on the tubular element.

Figure 9:
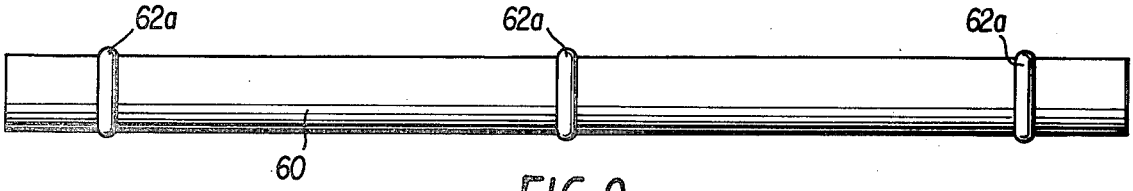
FIG. 9 is a front elevational view showing another bulged tubular member.
Figure 10:
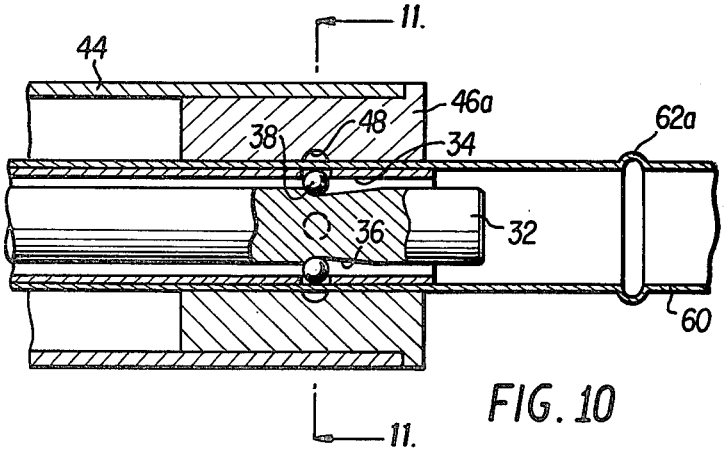
FIG. 10 is a fragmentary elevational view illustrating the bulging of the tubular member of FIG. 9.
Figure 11:
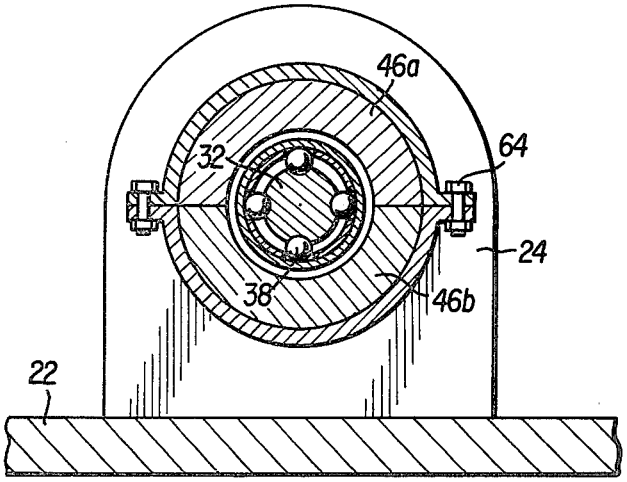
FIG. 11 is an end elevational view taken in vertical cross section along line 11—11 of FIG. 10.

Referring now to FIGS. 9 through 11, another form of formed tubular product is illustrated. In this embodiment the tubular member 60 is provided with a ring-like projection 62*a* on its periphery by inserting the tubular member 60 into the apparatus of FIG. 10. In this embodiment the die member is made from a plurality of parts such as 46*a*, 46*b* illustrated in FIG. 11. A separable bolt and nut assembly 64 permits the die members 46*a*, 46*b* to be separated to effect insertion and removal of the tubular product from the split die. Spaced ring-like projections 62*a* may be formed either by inserting the tubular member into the dies 46*a*, 46*b* a plurality of times or by providing the die member with a plurality of forming surfaces if the distance between adjacent projections 62*a* is not too great.

The projections formed on the tubular members in accordance with the present invention may be made for decorative purposes, to provide additional strength for the tubular members or to provide additional heat radiating surface.

While presently preferred embodiments of the invention have been illustrated and described, it will be recognized that the invention may be otherwise variously embodied and practiced within the scope of the claims which follow.

What is claimed is:

1. A method of forming projections on tubular members which comprises the steps of a. providing a mandrel having camming wedge members on the outer surface thereof with spherical forming members actuated by said camming wedge members, b. adjustably positioning said mandrel within a housing member with said mandrel being so positioned and arranged such that reciprocation of the mandrel moves the spherical forming members into and out of associated apertures in said housing member, c. positioning a die member in registry with the apertures in said housing member, d. positioning a tubular member to be formed between said housing member and said die member, e. and rotating said mandrel, said housing member and said die member in unison while preventing said tubular member from rotating thereby forming projections on said tubular member by said spherical forming members.

2. A method of forming projections on tubular members as defined in claim 1 including the step of using steel balls as said spherical forming members.

3. A method of forming projections on tubular members as defined in claim 1 including the additional steps of forming a helical path in said die member and ejecting said tubular member axially from between said housing member and said die member as said spherical forming members form projections in said tubular member.

4. A method of forming projections on tubular members as defined in claim 1 including the additional steps of forming at least one circular path in said die member and releasing said tubular member from between said housing member and said die member by forming said die member from a plurality of separable parts.

5. A method of forming projections on tubular members as defined in claim 1 including the additional steps of threading a portion of said mandrel and reciprocating said mandrel with handwheel means which threadedly engage the threaded portion of said mandrel.

6. A method of forming projections on tubular members as defined in claim 1 including the additional step of pinning said mandrel, housing member and die member together to effect rotation thereof in unison.

7. An apparatus for forming projections on tubular members which comprises:

a. a mandrel mounted for rotation,
   (1) said mandrel having camming wedge members on its outside surface, b. a housing member spaced from but closely adjacent said camming wedge members,
   (1) said housing member having an aperture in registry with each of said camming wedge members, c. a spherical forming member received in each of said camming wedge members, d. means for reciprocating said mandrel thereby camming said spherical forming members into and out of an associated aperture in said housing member, e. a die member having a tube forming surface spaced from the apertures in said housing member, f. a tubular member to be formed received between said housing member and said die member, g. and means to rotate said mandrel, said housing member said die member and said spherical forming members in unison when said forming members extend through the apertures in said housing member to impress said tubular member progressively into the forming surface of said rotating die member thereby forming a projection in said tubular member.

8. An apparatus for forming projections on tubular members as defined in claim 7 wherein said tube forming surface in said die member is in the form of a spiral and said tubular member being formed is ejected axially from said apparatus when said mandrel, housing member and spherical forming members are rotated in unison.

9. An apparatus for forming projections on tubular members as defined in claim 7 wherein said tube forming surface in said die member is in the form of a toroid and said die member is split into at least two parts to permit loading of the tubular member to be formed and unloading of the formed tube.

10. An apparatus for forming projections on tubular members as defined in claim 7 wherein said means for reciprocating said mandrel comprises a threaded portion on said mandrel and handwheel means having threaded engagement with the threaded portion on said mandrel.

11. An apparatus for forming projections on tubular members as defined in claim 7 wherein said means to rotate said mandrel, said housing member said die member and said spherical forming members in unison includes means for joining to each other the members to be rotated and sprocket means is attached to one of said members.

12. An apparatus for forming projections on tubular members as defined in claim 11 wherein said means for joining to each other the members to be rotated consists of a pin member and said sprocket means is attached to said die member.

* * * * *